US012692675B2

(12) United States Patent
Jeon

(10) Patent No.: US 12,692,675 B2
(45) Date of Patent: Jul. 28, 2026

(54) SHOCK-ABSORBING CAR SAFETY STOPPER

(71) Applicant: Gapsu Jeon, Yangsan-si (KR)

(72) Inventor: Gapsu Jeon, Yangsan-si (KR)

( * ) Notice: Subject to any disclaimer, the term of this patent is extended or adjusted under 35 U.S.C. 154(b) by 489 days.

(21) Appl. No.: 18/268,229

(22) PCT Filed: Jan. 12, 2022

(86) PCT No.: PCT/KR2022/000592
§ 371 (c)(1),
(2) Date: Jun. 18, 2023

(87) PCT Pub. No.: WO2022/154497
PCT Pub. Date: Jul. 21, 2022

(65) Prior Publication Data

US 2024/0052586 A1 Feb. 15, 2024

(30) Foreign Application Priority Data

Jan. 13, 2021 (KR) ..... 10-2021-0004954

(51) Int. Cl.
*E01F 15/00* (2006.01)

(52) U.S. Cl.
CPC ..... *E01F 15/003* (2013.01)

(58) Field of Classification Search
CPC ..... E01F 15/003
USPC ..... 404/6–10
See application file for complete search history.

(56) References Cited

U.S. PATENT DOCUMENTS 1,532,865 A * 4/1925 Beck ..... E01F 9/602 40/608
1,888,590 A * 11/1932 Greenlee ..... E01F 9/602 404/10
1,903,739 A * 4/1933 Tatlock ..... E01F 9/602 404/11
4,822,206 A * 4/1989 Roussel ..... E01F 13/085 404/6

(Continued)

FOREIGN PATENT DOCUMENTS

FR 2654449 B1 * 11/1989 ..... E01F 13/00
JP 2012-041730 A 3/2012

(Continued)

OTHER PUBLICATIONS

International Search Report of PCT/KR2022/000592, Mailed on Apr. 6, 2022.

*Primary Examiner* — Raymond W Addie
(74) *Attorney, Agent, or Firm* — Rivka Friedman

(57) ABSTRACT

The present invention relates to a shock-absorbing car safety stopper which damps an impact applied to a tire by a stopper during parking and is helpful in extending the life of a vehicle, the present invention provides a shock-absorbing car safety stopper comprising a base plate (10) which is installed on the ground surface of a parking lot, a touch bar (20) which is provided at a predetermined height above the base plate, a shaft (40) which connecting a fixed boy attached to an upper surface of the base plate (10) and a rotating body attached to a lower surface of the touch bar (20), and a coil spring (42) fitted to the shaft (40) to apply an elastic restoring force to the touch bar (20), so that the touch bar to damp an impact applied to a tire [T] enabling the tire to return it to the original position.

4 Claims, 3 Drawing Sheets

(56) References Cited

U.S. PATENT DOCUMENTS 4,875,797 A * 10/1989 Hartwig ..... E01F 13/085 404/9
4,886,232 A * 12/1989 Dicke ..... E01F 9/627 248/576
4,974,991 A * 12/1990 Mandavi ..... E01F 9/529 404/11
5,309,674 A * 5/1994 Weibel ..... E01F 13/08 404/6
5,597,262 A * 1/1997 Beavers ..... E01F 9/627 116/63 P
5,678,365 A * 10/1997 Venegas, Jr. ..... E01F 15/003 404/6
5,703,577 A * 12/1997 Carter ..... G08G 1/095 40/608
6,619,629 B1 * 9/2003 Boswell ..... E01F 9/629 404/9
6,890,122 B1 * 5/2005 Nielsen ..... E01F 9/627 116/63 P
7,441,982 B1 * 10/2008 Al-Sabah ..... E01F 13/105 404/6
8,678,701 B1 * 3/2014 Aldasem ..... E01F 13/085 404/11
2004/0165949 A1 * 8/2004 Rittenhouse ..... E01F 13/08 404/6
2006/0228177 A1 * 10/2006 Allain ..... E01F 13/06 404/6
2007/0207868 A1 * 9/2007 Burry ..... A63K 3/02 472/85
2008/0240854 A1 * 10/2008 Binns ..... E06B 11/08 49/46
2016/0145817 A1 * 5/2016 Teich ..... E01F 13/085 404/6

FOREIGN PATENT DOCUMENTS

KR 20-1989-0007381 Y1 10/1989
KR 10-2010-0113245 A 10/2010
KR 10-1080719 B1 11/2011
KR 20-0457074 Y1 12/2011
KR 10-2262434 B1 6/2021
KR 20230000080 U * 1/2023 ..... E04H 6/426

* cited by examiner

SHOCK-ABSORBING CAR SAFETY STOPPER

FIELD OF INVENTION

The present invention relates to a buffer type safety stopper provided in a parking lot, in particular, to a shock-absorbing safety car stopper that relieves impact force applied to a tire caused by the stopper during parking and helps to extend the lifetime of the vehicle.

BACKGROUND OF INVENTION

In general, a parking line dividing a parking area is displayed on a floor surface of a parking lot, and a parking block for guiding a stop position of a vehicle tire is installed at the rear of the parking area. Such a parking block is formed in a rectangular parallelepiped block shape to prevent the tire from passing easily, and is firmly fixed to the floor surface with an anchor bolt or the like.

Looking at the prior art (patent literatures) related to such a parking block, the 'buffer type car stopper' of (Patent Document 001) Korean Registered Patent No. 10-2197151 (registration date of Dec. 23, 2020) is already known. This is an invention filed by the same applicant (inventor) as of the present invention. In the above prior art (patent document), the vehicle tire is rotatably driven when it comes into contact with the touch bar, and thus a rolling frictional force is applied to the touch bar in a direction of rotating the tire. That is, the frictional force is applied to the touch bar in contact with the tire and a hinge connection part (shaft, etc.), hence entailing problems such as increasing a risk of damage and breakage, causing rolling frictional noise, and applying impact force to the vehicle, or the like.

SUMMARY OF INVENTION

Technical Problem to be Solved

Therefore, a technical object of the present invention is to provide a shock-absorbing safety car stopper that, when a tire comes into contact with a touch bar while a vehicle is parked, a sleeve rotates to offset frictional force so as to enable smooth operation, and conversely, in a state that the tire leaves the touch bar and the touch bar returns to its original position (parking standby), the sleeve is fixed by a holder to prevent rotation, thereby prevent pedestrian safety accidents.

Technical Solution

In order to achieve the above object, the present invention proposes a shock-absorbing safety car stopper, including: a base plate installed on a floor surface of a parking lot; a touch bar provided at a predetermined height above the base plate; a fixture attached to a top surface of the base plate; a rotating body ("rotor") attached to a bottom surface of the touch bar; a shaft for connecting the fixture and the rotor; and a coil spring that is inserted into the shaft and applies elastic restoring force (or resilience) to the touch bar, wherein the touch bar buffers (or absorbs) impact applied to a tire and puts the tire back to the original position when the tire escaped from the same, and is characterized in that the car stopper comprises: a sleeve that is cylindrically fitted to the touch bar and is in sliding contact with the tire; and a brake that includes a shaft hole formed to be fitted with the shaft, is provided in a longitudinal direction between the touch bar and the base plate, and has an upper end and a lower end provided to be adjacent to the sleeve and the base plate, respectively, so that the lower end comes into contact with the base plate while the upper end is closely fixed to the sleeve by rotational motion of the touch bar.

According to the present invention, the shaft hole is characterized in that it is formed in an elliptical shape.

According to the present invention, the upper end is characterized in that it is formed in a curve corresponding to the surface of the sleeve.

According to the present invention, the sleeve and the upper end are each characterized in that unevenness (凹凸) is formed on the surface thereof.

Effect of Invention

The present invention may offset the rolling frictional force by a rotational roller when the rotationally driven tire comes into contact with the touch bar, thereby effectively imparting smooth operation and further smoother riding and comport.

The present invention may prevent damage and breakage of hinge connection parts (fixture, rotor, shaft, etc.) as well as the touch bar, extend a lifetime of the same, eliminate rolling frictional noise with the tire and minimize tire wear, thereby effectively helping the extension of lifetime.

The present invention may be effective in preventing safety accidents such as slipping of the foot of a pedestrian since the sleeve is fixed by the holder in a state where a vehicle exits the parking lot, and thus, the touch bar is separated from the tire and rises back (standby for parking).

BEST MODE FOR CARRYING OUT INVENTION

Figure 1:
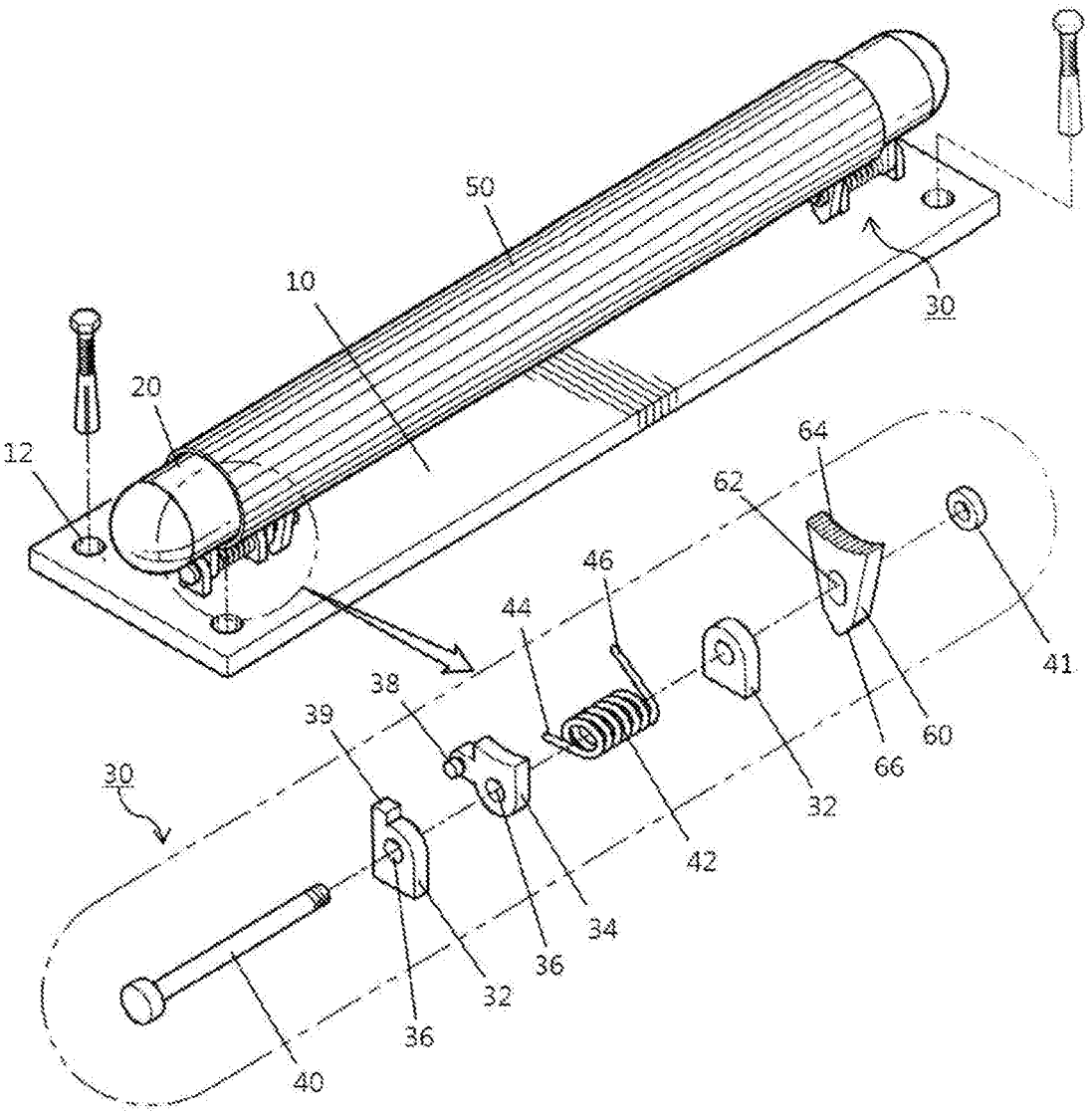
FIG. 1 is a perspective view showing main components of a shock-absorbing safety car stopper in separate state according to the present invention.

The shock-absorbing safety car stopper of the present invention may include: a base plate 10 installed on a floor surface of a parking lot; a touch bar 20 provided at a predetermined height above the base plate 10; a fixture 32 attached to a top surface of the base plate 10; a rotor 34 attached to a bottom surface of the touch bar 20; a shaft 40 for connecting the fixture and the rotor; and a coil spring 42 that is inserted into the shaft 40 and applies elastic restoring force (or resilience) to the touch bar 20, wherein the touch bar 20 absorbs impact applied to a tire T and puts the tire T back to the original position when the tire escaped from the same, and is characterized in that the car stopper comprises: a sleeve 50 that is cylindrically fitted to the touch bar 20 and is in sliding contact with the tire T; and a brake 60 that includes a shaft hole 62 formed to be fitted with the shaft 40, is provided in a longitudinal direction between the touch bar 20 and the base plate 10, and has an upper end 64 and a lower end 66 provided to be adjacent to the sleeve 50 and the base plate 10, respectively, so that the lower end 66 comes into contact with the base plate 10 while the upper end 64 is closely fixed to the sleeve 50 by rotational motion of the touch bar 20.

DETAILED DESCRIPTION OF PREFERRED EMBODIMENTS OF INVENTION

Hereinafter, embodiments of the present invention will be described in detail with reference to the accompanying drawings. When it is determined that a detailed description of known functions or configurations related thereto may unnecessarily obscure the gist of the present invention, the detailed description is omitted, and the same reference numerals refer to the same elements in the drawings.

Figure 2:
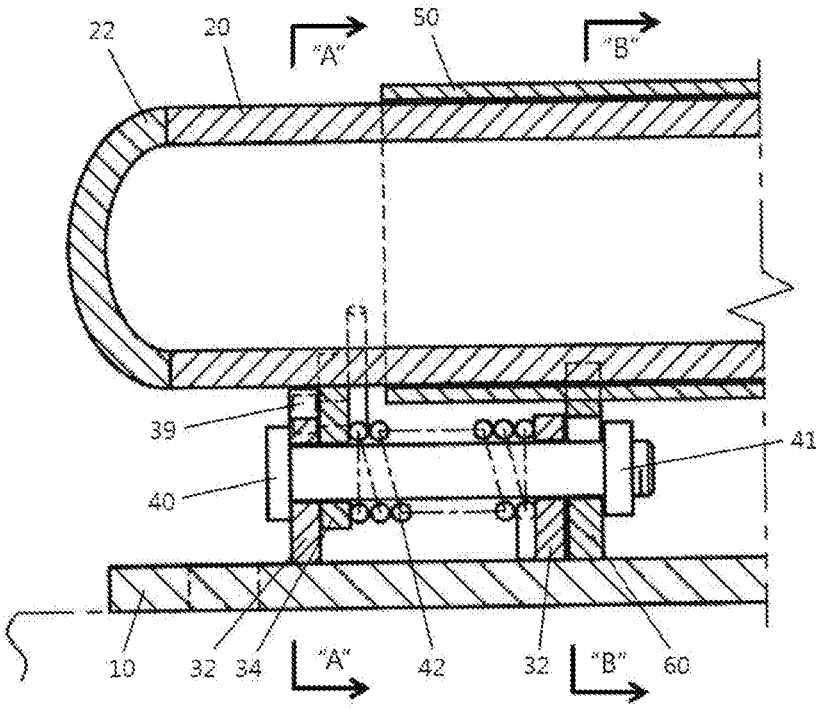
FIG. 2 is a front view showing the shock-absorbing safety car stopper according to the present invention in a longitudinal section.

FIG. 1 is a perspective view showing the configuration of a shock-absorbing safety car stopper according to a preferred embodiment of the present invention; FIG. 2 is a front view showing main parts of the above shock-absorbing safety car stopper in a longitudinal section; and FIG. 3 is a side view in a cross-section taken along line "A-A" of FIG. 2.

Figure 3:
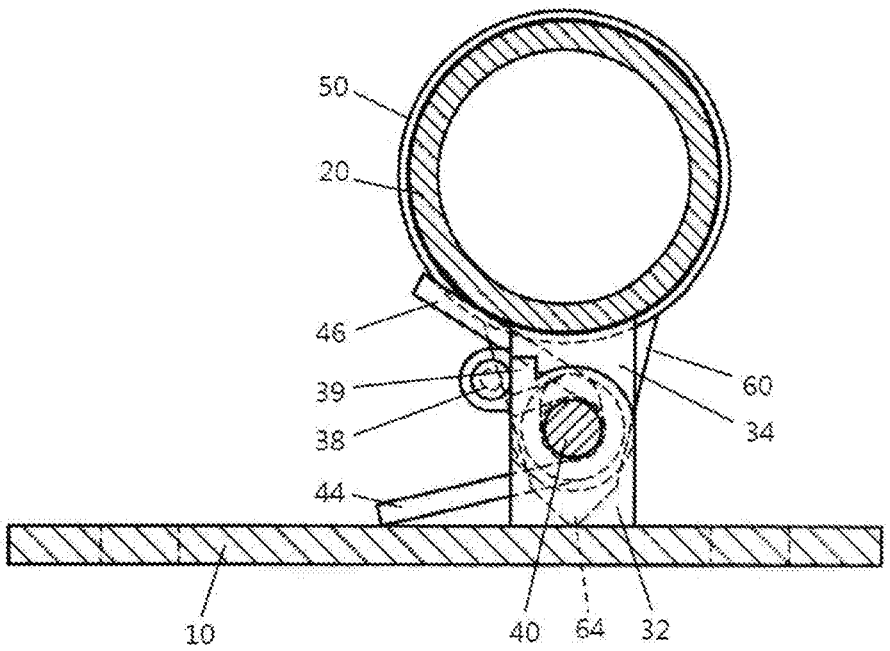
FIG. 3 is a side view in a cross-section taken along line "A-A" of FIG. 2.

Referring to FIGS. 1 to 3, the shock-absorbing safety car stopper according to a preferred embodiment of the present invention may be provided at a position where a tire T reaches the inside of a parking area, and may comprise a base plate 10, a touch bar 20 provided on the base plate 10 with which the tire T comes into contact, a buffer means 30 provided between the base plate 10 and the touch bar 20, a sleeve 50 and a brake 60.

The base plate 10 may be provided in one or plural at a tire reaching position and placed in a rectangular shape on the floor surface of a parking lot, and fixing screws 14 may be fitted to fixing holes 12 formed at an edge of the based plate. The touch bars 20 may be provided side by side in a horizontal direction at a predetermined interval on an upper portion of the base plate 10, formed to extend in a predetermined length, and be coupled with caps 22 at both ends thereof. The touch bar 20 may have a circular cross-section to thus minimize damage as the tire T comes into rolling contact with the touch bar, and may be formed as a hollow pipe or a full round bar.

The buffer means 30 may be provided for elastically supporting the touch bar 20, and thus is disposed on both lower sides of the touch bar 20 and connects the base plate 10 and the touch bar 20 in order to support the touch bar 20 at a predetermined height. The buffer means 30 may elastically absorb and relieve impact force when a lateral load by the tire T acts on the touch bar 20, while putting the touch bar 20 back to its original position when the lateral load of the tire is removed. On the other hand, the touch bar 20 may be formed with a length of about 200 to 500 mm in consideration of the width of a tire at one side, or may be formed to extend in a length longer than 1500 to 2000 mm so that the tires at both sides of a vehicle can contact the touch bar simultaneously. As the length increases, the number of the buffer means 30 may also be increased to two or more.

The buffer means 30 may include: a fixture 32 attached to a top surface of the base plate 10 at a predetermined interval; a rotating body ("rotor") 34 attached to a bottom surface of the touch bar 20 and hinge-coupled to the fixture 32; a shaft 40 and nuts 41 for hinge-coupling the fixture 32 and the rotor 34; and a coil spring 42 inserted into the shaft 40 to apply an elastic restoring force. In this regard, the fixture 32 may be provided in one or plural on the top surface of the base plate 10, specifically, a pair of fixtures is installed in the longitudinal direction at a predetermined interval, and a connection hole 36 is formed on one side thereof. The shaft 40 is fitted to the connection hole 36, and the fixture 32 and the rotor 34 are coupled with a hinge by coupling the nuts 41. The fixture 32 and the rotor 34 are hinge-coupled by fitting the shat 40 into the connection hole 36, a holder 38 provided on the rear side of the rotor 34 is engaged with a stopper sill 39 formed on an upper portion at the rear side of the fixture 32, so that the touch bar 20 is secured in a standing state for parking standby. The holder 38 may rotate downward (counter-clockwise) along with the rotor 34 according to the operation of the touch bar 20 and may be released from the fixing state while being separated from the stopper sill 39.

The coil spring 42 acts with an elastic restoring force against a load applied from the outside. Specifically, the coil spring is fitted to the shaft 40 and fixed in a state that a first end 44 at one side is in close contact with the base plate 10 downwardly while a second end 46 at the other side is closely fixed in the touch bar 20 upwardly. Accordingly, when a load is applied to the touch bar 20 backward (left in the drawing), a torsion moment is generated in the coil spring 42 while turning a predetermined section. On the other hand, when the load is removed, a restoring force is elastically applied. Further, the coil spring 42 may further comprise clockwork, a leaf spring, a compression cylinder with acting a compression (extension) restoring force, or the like.

The sleeve 50 is inserted into a circumferential surface of the touch bar 20 in a cylindrical shape to come into sliding contact. To this end, the sleeve has an inner diameter of about 0.5 to 3 mm larger than the circumferential surface (outer diameter) of the touch bar 20, and may be possibly idled in a no-load state so that the tire T can be naturally interlocked when coming into rotatable contact. That is, when the tire T comes into contact with the touch bar 20, the rolling frictional force is offset by the sleeve 50 so that the touch bar 20 can be operated smoothly. Conversely, even when the tire T is separated from the touch bar 20, the sleeve 50 rotates and the touch bar 20 can naturally return to its original position.

The brake 60 is assembled on the outer surface of the rotor 34 by inserting the shaft 40 into the shaft hole 62 at a middle part thereof, and may be provided in a longitudinal direction between the touch bar 20 and the base plate 10. An upper end 64 of the brake 60 is adjacent to the sleeve 50 while a lows end 66 thereof is standing in the longitudinal direction close to a vertical line so as to be close to the base plate 10, thereby applying a fixing force to the brake 60. Specifically, the upper end 64 formed on an upper portion of the shaft hole 62 is close contact with or separated from the sleeve 50, while the lower end 66 protrudes from a lower portion of the shaft hole 62 downwardly and is close contact with or separated from the base plate 10. As shown in the figure, the lower end 66 may be formed in a 'V' shape or, although not shown in an alternative figure, may have a semi-elliptical form in a 'U' shape. The lower end 66 may be formed such that a length between the bottom surface of the shaft hole 62 and the tip of the lower end 66 is longer than an interval between the shaft 40 and the base plate 10, whereby the fixing force may be applied when the brake 60 rotates downward. In other words, the brake 60 may secure or release the sleeve 50 while interlocking with the touch bar 20 and turning a section according to the guidance of the shaft 40, like a cam manner. The brake 60 may be installed in one or plural between the touch bar 20 and the base plate 10. Specifically, as shown in the figure, it may be mounted on one side of the shaft 40 of the buffer means 30. Otherwise, although not shown in an alternative figure, it can be installed as a separate configuration on the top surface of the base plate 10. Further, the base plate 10 may be provided with a cover (not shown) surrounding the buffer means 30 and the brake 60, thereby preventing inflow of foreign substances from the outside.

Since the shock-absorbing safety car stopper of the present invention is mostly installed in an outdoor or indoor parking lot, the base plate 10, the touch bar 20 and cap 22, the fixture 32 and rotor 34, the shaft 40, the sleeve 50, and the brake 60 may be made of metal materials such as stainless steel and iron (plating, painting) with excellent corrosion resistance and durability, as well as beautiful appearance, or may also be made of hard synthetic resin, acrylic, synthetic rubber, etc. However, the coil spring 42 should be made of a metal material such as stainless steel having excellent elasticity (restoring) force.

According to the present invention, the shaft hole 62 is characterized in that it is formed in an elliptical shape. The brake 60 is flowable through the shaft hole 62 and is fitted between the base plate 10 and the shaft 40 in order to secure the sleeve 50. In the brake 60, the shaft hole 62 is formed in an elliptical shape so that the lower end 66 comes into contact with the base plate 10 and rises a section along the shaft hole 62. Further, the bottom surface of the shaft hole 62 comes into contact with the shaft 40 and, at the same time, the lower end 66 is in close contact with the base plate 10, rises a section and stands close to a vertical line, so that the upper end 64 is closely fixed to the sleeve 50, and stopped thereto. That is, when the shock-absorbing safety car stopper of the present invention is waiting for parking as shown in FIG. 3, the upper end 64 and the lower end 66 are closely fixed to the sleeve 50 and the base plate 10, respectively, by the brake 60, thereby preventing idle rotation.

According to the present invention, the upper end 64 is characterized in that it is formed in a curve shape corresponding to a surface of the sleeve 50. Specifically, the upper end 64 of the brake 60 is formed to be concave with a curved surface corresponding to the surface of the sleeve 50, thereby widening a contact area with the sleeve 50, increasing the fixing force and preventing malfunction.

Further, according to the present invention, the sleeve 50 and the upper end 64 are each characterized in that the surface has unevenness (凹凸). Specifically, the sleeve 50 and the brake 60 may have grooves (凹) or protrusions (凸) formed on the surfaces so that the fixing force of the sleeve is further increased. The unevenness (凹凸) may be elongated or partially formed along the longitudinal direction of the touch bar 20. As such, the shock-absorbing safety car stopper of the present invention may inhibit a slip phenomenon in a stopped state of the sleeve 50 while waiting for parking, thereby preventing safety accidents in advance.

Figure 4:
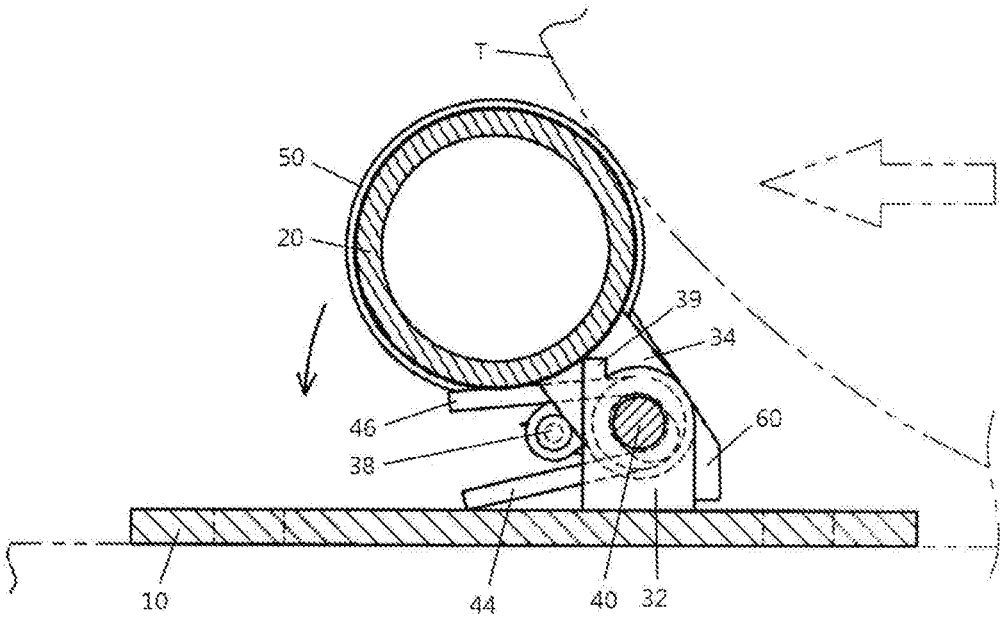
FIG. 4 is an operation state diagram of the shock-absorbing safety car stopper in a cross-section taken along line "B-B" of FIG. 2.
Figure 5:
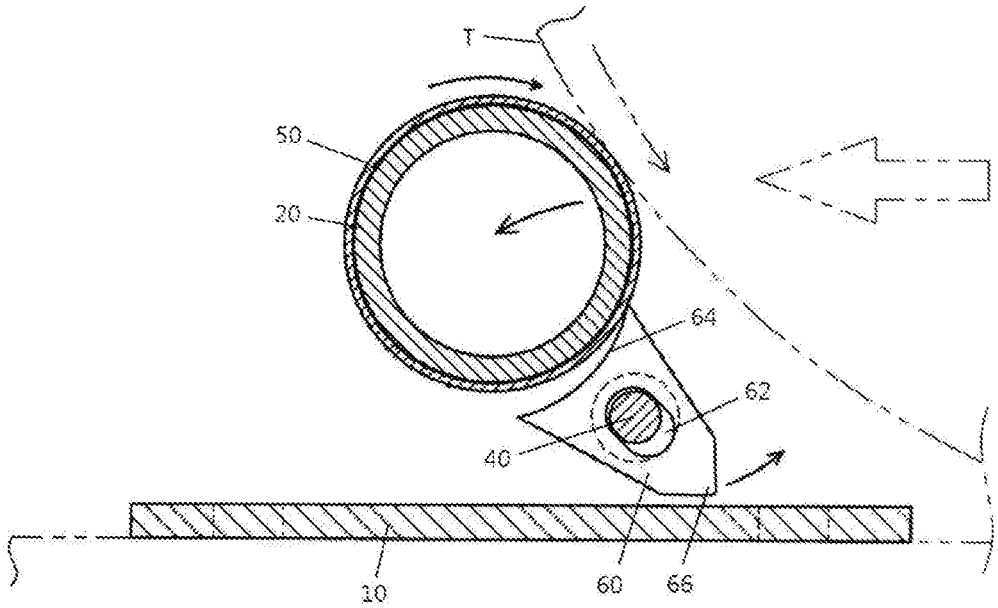
FIG. 5 is an operation state diagram of the sleeve 50 and the brake 60 according to the present invention.

FIG. 4 is an operation state diagram of the shock-absorbing safety car stopper according to the present invention.

Referring to FIG. 4, when a vehicle is parked in a parking standby state, if the tire T comes into contact with the sleeve 50, the touch bar 20 turns a section with respect to the shaft 40 and is tilted backward (left side in the figure). At this time, a resistance force of the coil spring 42 (tension or compression) acts to absorb and relieve impact elastically so that a traveling speed of the vehicle is gradually decelerated and finally stopped. At this time, the upper end of the brake 60 turns a section backward (left side in the figure) and, at the same time, the lower end 66 is separated from the base plate 10 to thus release the fixing of the sleeve 50. Further, the sleeve 50 rotates (clockwise) while interlocking in the rotating direction of the tire T (counter-clockwise) so that the touch bar 20 can be naturally tilted in the traveling direction of the tire T. On the other hand, the brake 60 is stopped in a state in which an upper tip portion of the upper end 64 is naturally hung onto the sleeve 50 due to its own weight.

Conversely, when the tire T is released from the shock-absorbing safety car stopper while the vehicle under parking is driven out of the parking area, the touch bar 20 turns a section forward (right side in the figure) by the elastic restoring force of the coil spring 42 to thus return to the original position. In addition, the sleeve 50 pushes the upper end 64 forward and turns a section about the shaft 40 to thus stand the brake 60 in a longitudinal direction. Then, the lower end 66 of the brake 60 comes into contact with the base plate 10 and rises in a section according to the guidance of the shaft hole 62, while the upper end 64 is safely and closely fixed to the sleeve 50, thereby preventing safety accidents such as slipping of the foot of a pedestrian while contacting the sleeve 50.

In addition, with regard to the shock-absorbing safety car stopper of the present invention, the existing general parking blocks (not shown) may be provided side by side at a predetermined interval on the rear side of the touch bar 20 on the top surface of the base plate 10 (left side in the figure), so that the touch bar 20 may firstly buffer (or absorb) impact and then the vehicle can be stopped more safely by the parking block. In this case, the parking block is formed in a rectangular or trapezoidal hexahedron shape, etc., and may comprise any existing parking block and car stopper distributed in the art. Thereby, after separating the parking block installed in the existing parking lot from the floor surface, this parking block may be re-installed together with the base plate 10 so that it can be recycled. Therefore, with regard to the shock-absorbing safety car stopper of the present invention, impact force applied to the tire T may be reduced owing to the first shock-absorbing action by the touch bar 20, thereby further preventing damage to the parking block.

INDUSTRIAL APPLICABILITY

The shock-absorbing safety car stopper according to the present invention may alleviate impact force applied to a tire caused by a stopper when a vehicle is parked in a parking lot, to thus impart smooth ride and comfort, and may further prevent shock and damage to the vehicle, thereby being helpful for extending the lifetime of the vehicle.

What is claimed is:

1. A shock-absorbing safety car stopper, comprising:

a base plate installed on a floor surface of a parking lot (10); a touch bar (20) provided at a predetermined height above the base plate (10); a fixture (32) attached to a top surface of the base plate (10); a rotor (34) attached to a bottom surface of the touch bar (20); a shaft (40) for connecting the fixture and the rotor; and a coil spring (42) is fitted to the shaft (40) and applies the elastic restoring force to the touch bar (20), wherein the touch bar (20) absorbs impact applied to a tire (T) and puts the tire (T) back to the original position when the tire escaped from the same, wherein the car stopper is characterized by comprising:

a sleeve (50) that is cylindrically fitted to the touch bar (20) and is in sliding contact with the tire (T); and a brake (60) that includes a shaft hole (62) formed to be fitted with the shaft (40), is provided in a longitudinal direction between the touch bar (20) and the base plate (10), and has an upper end (64) and a lower end (66) provided to be adjacent to the sleeve (50) and the base plate (10), respectively, so that the lower end (66) comes into contact with the base plate (10) while the upper end (64) is in close contact with the sleeve (50) by rotational motion of the touch bar (20).

2. The car stopper according to claim 1, wherein the shaft hole (62) is formed in an elliptical shape.

3. The car stopper according to claim 1, wherein the upper end (64) is formed in a curve corresponding to the surface of the sleeve (50).

4. The car stopper according to claim 1, wherein the sleeve (50) and the upper end (64) each include unevenness (凹凸) formed on the surface thereof.

* * * * *